US007156086B1

(12) United States Patent
Wells

(10) Patent No.: US 7,156,086 B1
(45) Date of Patent: Jan. 2, 2007

(54) BOW HOLDING STAND ASSEMBLY

(76) Inventor: Carl B. Wells, 6014 Delfair La., Milford, OH (US) 45150

( * ) Notice: Subject to any disclaimer, the term of this patent is extended or adjusted under 35 U.S.C. 154(b) by 95 days.

(21) Appl. No.: 11/124,559

(22) Filed: May 9, 2005

(51) Int. Cl.
*F41B 5/00* (2006.01)

(52) U.S. Cl. ..... 124/89; 248/156; 248/545

(58) Field of Classification Search ..... 248/156, 248/545, 688; 124/88, 89, 86; 43/21.2; 211/64, 85.7, 13.1, 60.1
See application file for complete search history.

(56) References Cited

U.S. PATENT DOCUMENTS

| | | | | |
|---|---|---|---|---|
| 1,851,779 | A | 3/1932 | Slater | |
| 3,256,872 | A | 6/1966 | Koser | |
| D260,674 | S | 9/1981 | Simmons et al. | |
| 4,474,296 | A | 10/1984 | Hartman | |
| 4,938,446 | A * | 7/1990 | Williams | 248/530 |
| 5,106,044 | A | 4/1992 | Regard, III et al. | |
| 5,205,272 | A * | 4/1993 | Boyer | 124/89 |
| 5,775,658 | A | 7/1998 | Englehardt | |
| 6,131,556 | A | 10/2000 | Villarreal | |
| 6,749,170 | B1 * | 6/2004 | Rhoads | 248/545 |
| 7,036,497 | B1 * | 5/2006 | Horn | 124/86 |
| 2001/0011435 | A1 * | 8/2001 | Baynard et al. | 43/21.2 |
| 2005/0150484 | A1 * | 7/2005 | Horn | 124/86 |

* cited by examiner

*Primary Examiner*—Ramon O Ramirez

(57) ABSTRACT

A bow holding stand assembly includes a rod that has a bottom end that is extendable into a ground surface. A plate has a first end, a second end, an upper surface, a lower surface, a first side edge and a second side edge. The lower surface is attached to a top end of the rod. A pair of legs is attached to and extends upwardly from the plate. The legs are angled away from the first end of the plate. A bracket is attached to and extends between distal ends of the legs with respect to the plate. A pair of arms is provided. Each of the arms is attached to one of the legs. A bow has a bottom edge and a front surface. The front surface is abuttable against the bracket and the bottom edge is abuttable against the arms.

8 Claims, 4 Drawing Sheets

BOW HOLDING STAND ASSEMBLY

BACKGROUND OF THE INVENTION

1. Field of the Invention

The present invention relates to bow stand devices and more particularly pertains to a new bow stand device for supporting a bow above a ground surface so that the bow is placed in a generally vertical orientation when not in use.

2. Description of the Prior Art

The use of bow stand devices is known in the prior art. U.S. Pat. No. 1,851,779 describes a clamp that is attachable to a bow and which includes an attached stake which may be extended into a ground surface to support the bow above the ground in a horizontal position. Another type of bow stand device is U.S. Pat. No. 3,256,872 having a post that is extendable into a ground a surface and which has an upper end that has a mounting pivotally coupled thereto for receiving a bow. The bow is placed on the ground and leaned against the mounting. Yet another such device is found in U.S. Pat. No. 4,474,296 which includes a stand having a base positionable on a ground surface and which includes a plurality of supporting members for holding a bow, on the base, in a vertical orientation.

While these devices fulfill their respective, particular objectives and requirements, the need remains for a device that is extendable into a ground surface for supporting a mounting onto which a bow may be positioned so that the bow is supported in a vertical orientation spaced from the ground surface. In this position, it will be relatively easy for a person shooting the bow to reach for and use the bow.

SUMMARY OF THE INVENTION

The present invention meets the needs presented above by generally comprising a rod that has a bottom end and a top end. The bottom end is extendable into a ground surface. A plate has a first end, a second end, an upper surface, a lower surface, a first side edge and a second side edge. The lower surface is attached to the top end of the rod. A pair of legs is attached to and extends upwardly from the plate. The legs are orientated parallel to each other and each is positioned on one of the first and second side edges. Each of the legs is angled away from the first end of the plate. A bracket is attached to and extends between distal ends of the legs with respect to the plate. A pair of arms is provided. Each of the arms has a bend therein so that a first portion a second portion of the arms is defined. Each of the first portions is attached to one of the legs and is angled upwardly and toward the first end of the plate. A bow has a bottom edge and a front surface. The front surface is abuttable against the bracket and the bottom edge is abuttable against the arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
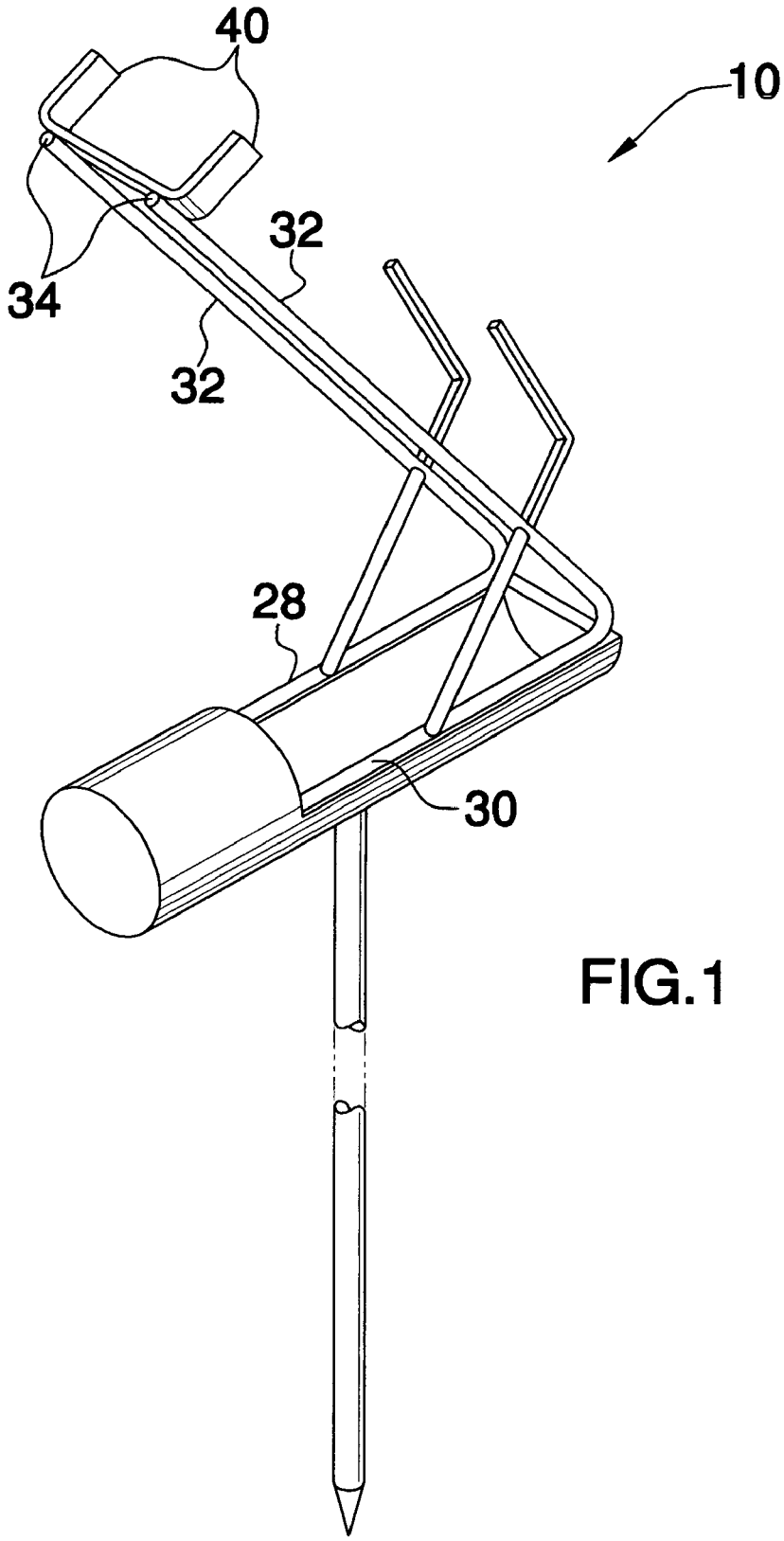
FIG. 1 is a perspective view of a bow holding stand assembly according to the present invention.
Figure 3:
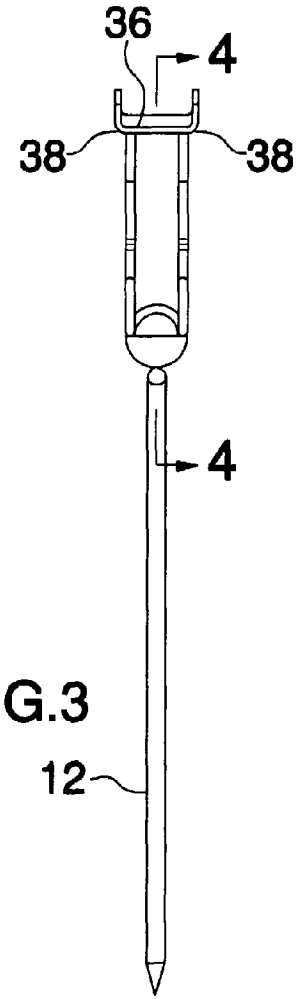
FIG. 3 is a front view of the present invention.
Figure 2:
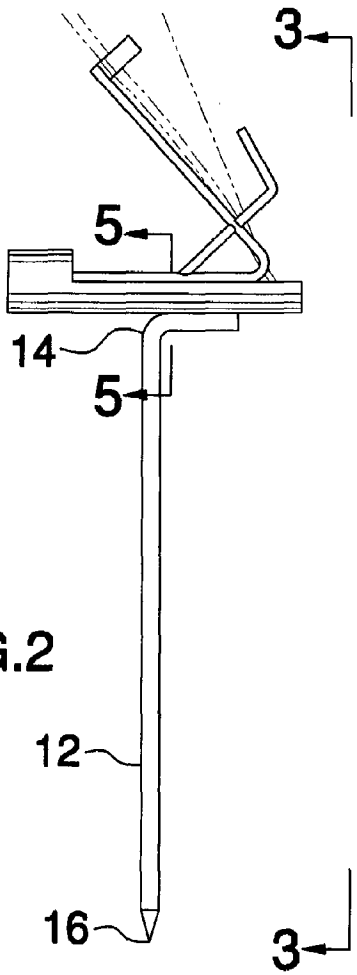
FIG. 2 is a side view of the present invention.
Figure 4:
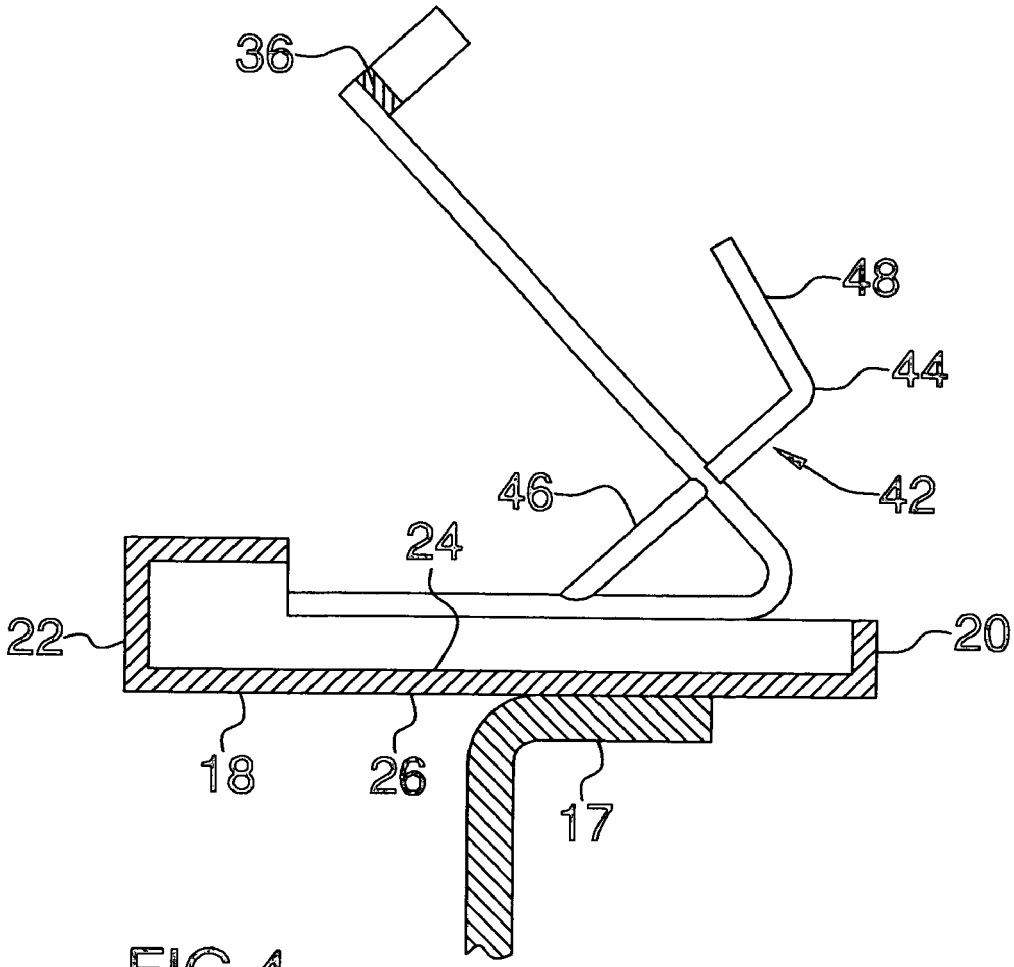
FIG. 4 is a cross-sectional view taken along line 4—4 of FIG. 3 of the present invention.
Figure 5:
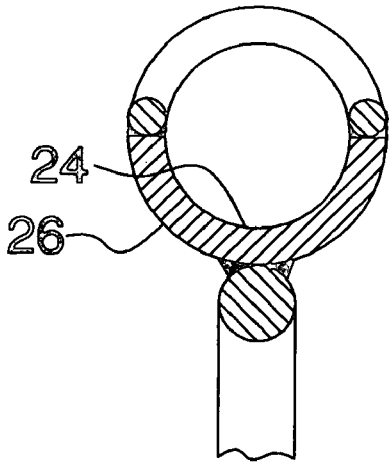
FIG. 5 is a cross-sectional view taken along line 5—5 of FIG. 2 of the present invention.

With reference now to the drawings, and in particular to FIGS. 1 through 6 thereof, a new bow stand device embodying the principles and concepts of the present invention and generally designated by the reference numeral 10 will be described.

As best illustrated in FIGS. 1 through 6, the bow holding stand assembly 10 generally comprises a rod 12 that has a bottom end 14 and a top end 16. The bottom end 14 is pointed. The rod 12 has a height from the bottom end 14 to the top end 16 generally between 12 inches and 36 inches. The bottom end 14 is removably extendable into a ground surface.

A plate 18 has a first end 20, a second end 22, an upper surface 24, and a lower surface 26, a first side edge 28 and a second side edge 30. The lower surface 26 is attached to the top end 14 of the rod 12. The rod 12 may include a support portion 17 extending along the lower surface 26. A longitudinal axis of the plate 18 extending through the first 20 and second 22 ends is orientated perpendicular to the rod 12. The plate 18 is arcuate so that the upper surface 24 has a concave cross-section taken perpendicular to first 28 and second 30 side edges.

A pair of legs 32 is attached to and extends upwardly from the plate 18. The legs 32 are orientated parallel to each other. Each of the legs 32 is positioned on one of the first 28 and second 30 side edges and each of the legs 32 is angled away from the first end 20 of the plate 18.

A bracket 36 is attached to and extends between distal ends 34 of the legs 32 with respect to the plate 18. The bracket 36 has a pair of outer ends 38 extending laterally outwards from the legs 32. A pair of flanges 40 is provided. Each of the flanges 40 is attached to and extends generally upwardly from the outer ends 38. The flanges 40 are angled toward the first end 20.

A pair of arms 42 is also provided. Each of the arms 42 has a bend 44 therein so that a first portion 46 a second portion 48 of the arms 42 is defined. Each of the first portions 46 is attached to one of the legs 32 and is angled upwardly and toward the first end 20 of the plate 18. The arms 42 are positioned nearer to the plate 12 than the distal ends 34. Each of the second portions 48 is angled upwardly and away from the first end 20 so that each of the second portions 48 generally extends toward the bracket 36. The first portions 46 are orientated parallel to each other and the second portions 48 are also orientated parallel to each other.

Figure 6:
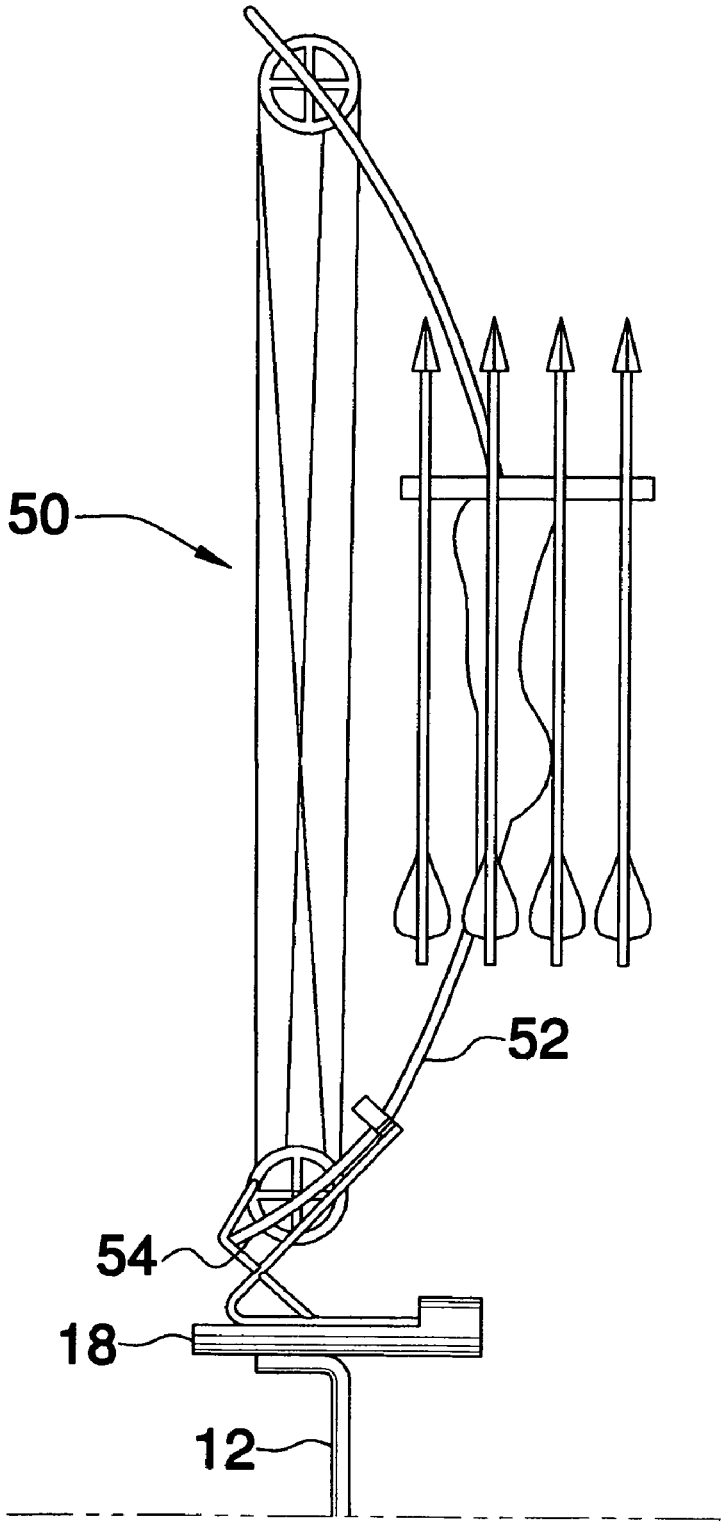
FIG. 6 is a side in-use view of the present invention.

A conventional bow 50 is provided which has a bottom edge 52 and a front surface 54. The front surface 54 is abuttable against the bracket 36 and the bottom edge 52 is then abuttable against the arms 42. This supports the bow 50 in an upright position as is shown in FIG. 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stand assembly for a bow, said assembly comprising:

a rod having a bottom end and a top end, said bottom end being extendable into a ground surface;

a plate having a first end, a second end, an upper surface, a lower surface, a first side edge and a second side edge, said lower surface being attached to said top end of said rod;

a pair of legs being attached to and extending upwardly from said plate, said legs being orientated parallel to each other, each of said legs being positioned on one of said first and second side edges, each of said legs being angled away from said first end of said plate;

a bracket being attached to and extending between distal ends of said legs with respect to said plate;

a pair of arms, each of said arms having a bend therein such that a first portion a second portion of said arms is defined, each of said first portions being attached to one of said legs and being angled upwardly and toward said first end of said plate; and a bow having a bottom edge, said bow having a front surface being abuttable against said bracket such that a bottom edge of said bow abuts said arms.

2. The assembly according to claim 1, wherein said bottom end is pointed.

3. The assembly according to claim 1, wherein said rod having a height from said bottom end to said top end generally between 12 inches and 36 inches.

4. The assembly according to claim 1, wherein a longitudinal axis of said plate extending through said first and second ends being orientated perpendicular to said rod.

5. The assembly according to claim 4, wherein said plate is arcuate such that said upper surface has a concave cross-section taken perpendicular to first and second side edges.

6. The assembly according to claim 1, further including a pair of flanges, said bracket having a pair of outer ends extending laterally outwards from said legs, each of said flanges being attached to and extending generally upwardly from said outer ends.

7. The assembly according to claim 6, wherein said flanges are each angled toward said first end.

8. A stand assembly for a bow, said assembly comprising:

a rod having a bottom end and a top end, said bottom end being pointed, said rod having a height from said bottom end to said top end generally between 12 inches and 36 inches, said bottom end being extendable into a ground surface;

a plate having a first end, a second end, an upper surface, a lower surface, a first side edge and a second side edge, said lower surface being attached to said top end of said rod, a longitudinal axis of said plate extending through said first and second ends being orientated perpendicular to said rod, said plate being arcuate such that said upper surface has a concave cross-section taken perpendicular to first and second side edges;

a pair of legs being attached to and extending upwardly from said plate, said legs being orientated parallel to each other, each of said legs being positioned on one of said first and second side edges, each of said legs being angled away from said first end of said plate;

a bracket being attached to and extending between distal ends of said legs with respect to said plate, said bracket having a pair of outer ends extending laterally outwards from said legs;

a pair of flanges, each of said flanges being attached to and extending generally upwardly from said outer ends, said flanges each being angled toward said first end;

a pair of arms, each of said arms having a bend therein such that a first portion a second portion of said arms is defined, each of said first portions being attached to one of said legs and being angled upwardly and toward said first end of said plate, said arms being positioned nearer to said plate than said distal ends, each of said second portions being angled upwardly and away from said first end such that each of said second portions generally extends toward said bracket, said first portions being orientated parallel to each other, said second portions being orientated parallel to each other; and a bow having a bottom edge, said bow having a front surface being abuttable against said bracket such that said bottom edge of said bow abuts said arms.

* * * * *